US006558205B1

(12) United States Patent
Shi et al.

(10) Patent No.: US 6,558,205 B1
(45) Date of Patent: May 6, 2003

(54) MODULAR JACK

(75) Inventors: GuangXing Shi, Kunsan (CN); Suiya Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/035,577

(22) Filed: Dec. 27, 2001

(51) Int. Cl.[7] ..... H01R 24/00
(52) U.S. Cl. ..... 439/676; 439/325; 439/567
(58) Field of Search ..... 439/325, 326, 439/327, 567, 568, 676

(56) References Cited

U.S. PATENT DOCUMENTS 4,688,875 A * 8/1987 O'Connor ..... 439/676
5,401,187 A * 3/1995 Ortega ..... 439/567
5,697,812 A * 12/1997 Sampson et al. ..... 439/567
5,797,768 A * 8/1998 Francaviglia ..... 439/567
6,190,210 B1 * 2/2001 Belopolsky et al. ..... 439/676
6,257,926 B1 * 7/2001 Hwang ..... 439/567
6,354,884 B1 * 3/2002 Yeh et al. ..... 439/680

* cited by examiner

*Primary Examiner*—Tho D. Ta
*Assistant Examiner*—Truc Nguyen
(74) *Attorney, Agent, or Firm*—Wei Te Chung

(57) ABSTRACT

A modular jack (1) mounted on a printed circuit board includes an insulating housing (10) having a bottom wall (13) and a pair of contacts (20) received in the housing. A pair of resilient posts (18) extend from opposite sides of the bottom wall. Each resilient post includes an outer section (182) and an inner section (181) with a slit (183) being defined therebetween. The bottom wall also has a tail post (19) downwardly extending from the middle of a rear end thereof, which is configured as a half column.

4 Claims, 5 Drawing Sheets

MODULAR JACK

BACKGROUND OF THE INVENTION

1. Field of the Invention

The present invention relates to a modular jack mounted on a printed circuit board, and particularly to a modular jack having a retaining means for securing the modular jack on the printed circuit board.

2. Description of Prior Art

Modular jacks are widely used to transmit voice and data in the telephone industry. Under some circumstances, the modular jacks are directly mounted on a printed circuit board to couple with a complementary plug. A continuing problem with such modular jacks is how to securely mount the modular jacks on the printed circuit board. The related arts are shown in Taiwan Patents No. 240879 and 322214. As disclosed in these patents, a pair of posts are employed for inserting in corresponding holes of the printed circuit board to provide the modular jacks with stability to assist in soldering the contacts on the printed circuit board. However, such a pair of posts could not positively maintain the modular jack in a stable state during insertion and withdrawal of the complementary plug. Meanwhile, when it requires that the contacts of the modular jacks be soldered with a cable, the two posts could not secure the modular jack on the printed circuit board at all.

Hence, an improved modular jack is required to overcome the disadvantages of the prior art.

BRIEF SUMMARY OF THE INVENTION

An object of the present invention is to provide an improved modular jack, which can be securely fixed on a printed circuit board.

A modular jack for being mounted on a printed circuit board in accordance with the present invention comprises an insulating housing defining a plug insertion hole for retaining therein a mating plug, and a pair of contacts accommodated in the insulating housing. A pair of resilient posts extend from opposite sides of a bottom wall of the insulating housing for being inserted into corresponding through holes of the printed circuit board to secure the modular jack thereon. Each resilient post includes an outer section and an inner section, between which a slit is defined to increase the resilience of the post. The outer section comprises a projection extending into the slit and an annular forwardly extending protrusion at a bottom end thereof for preventing the modular jack from turning backwards. The inner section comprises a rib on an inner side thereof for preventing the modular jack from leaving off the printed circuit board. The bottom wall also comprises a tail post at a rear end, which is configured as a half column. The tail post comprises an annular tail projection rearwardly extending from a bottom end thereof for preventing the modular jack from turning forwardly.

Other objects, advantages and novel features of the invention will become more apparent from the following detailed description of the present embodiment when taken in conjunction with the accompanying drawings.

DETAILED DESCRIPTION OF THE INVENTION

Figure 1:
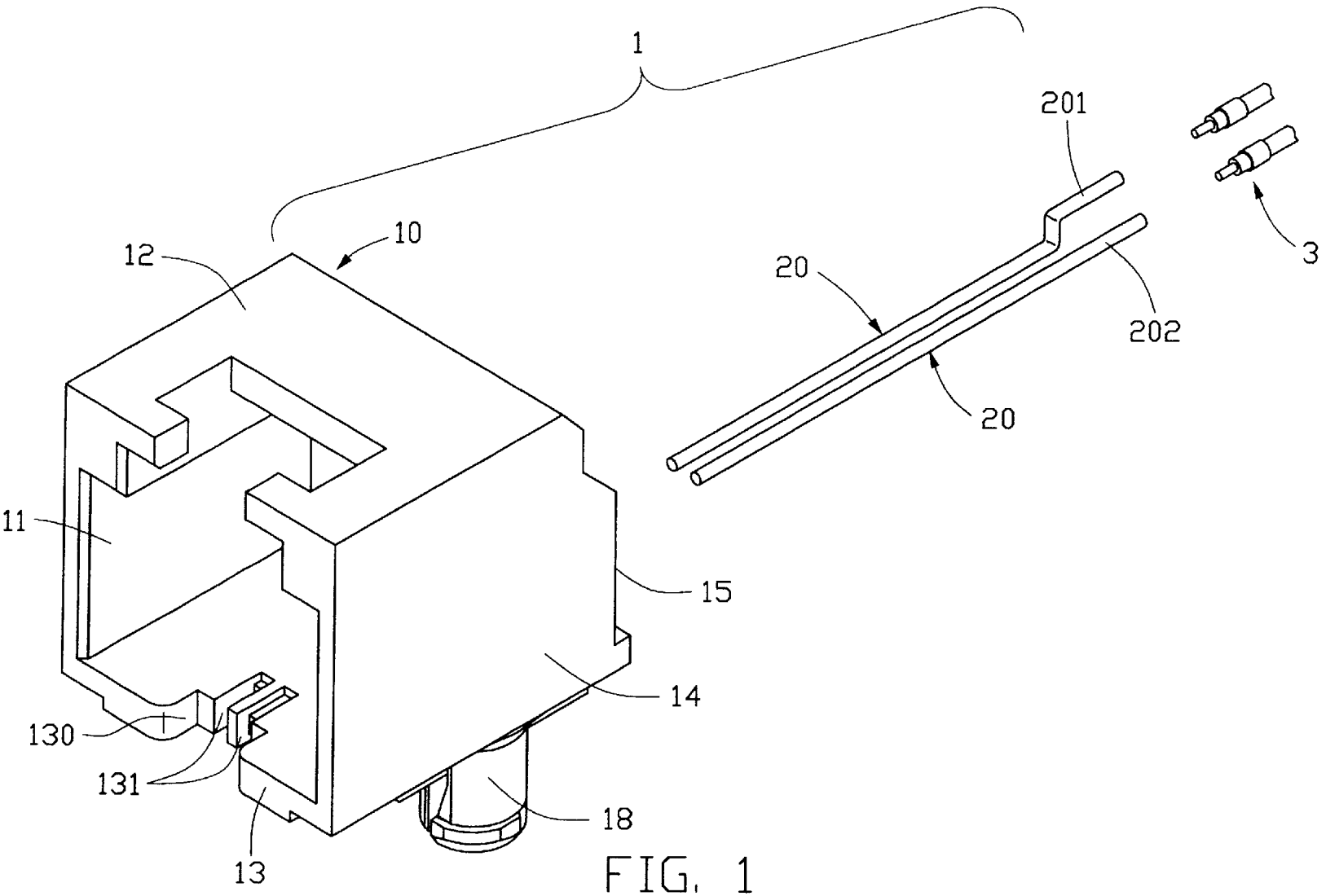
FIG. 1 is an exploded, perspective view of a modular jack in accordance with the present invention and a pair of wires.
Figure 2:
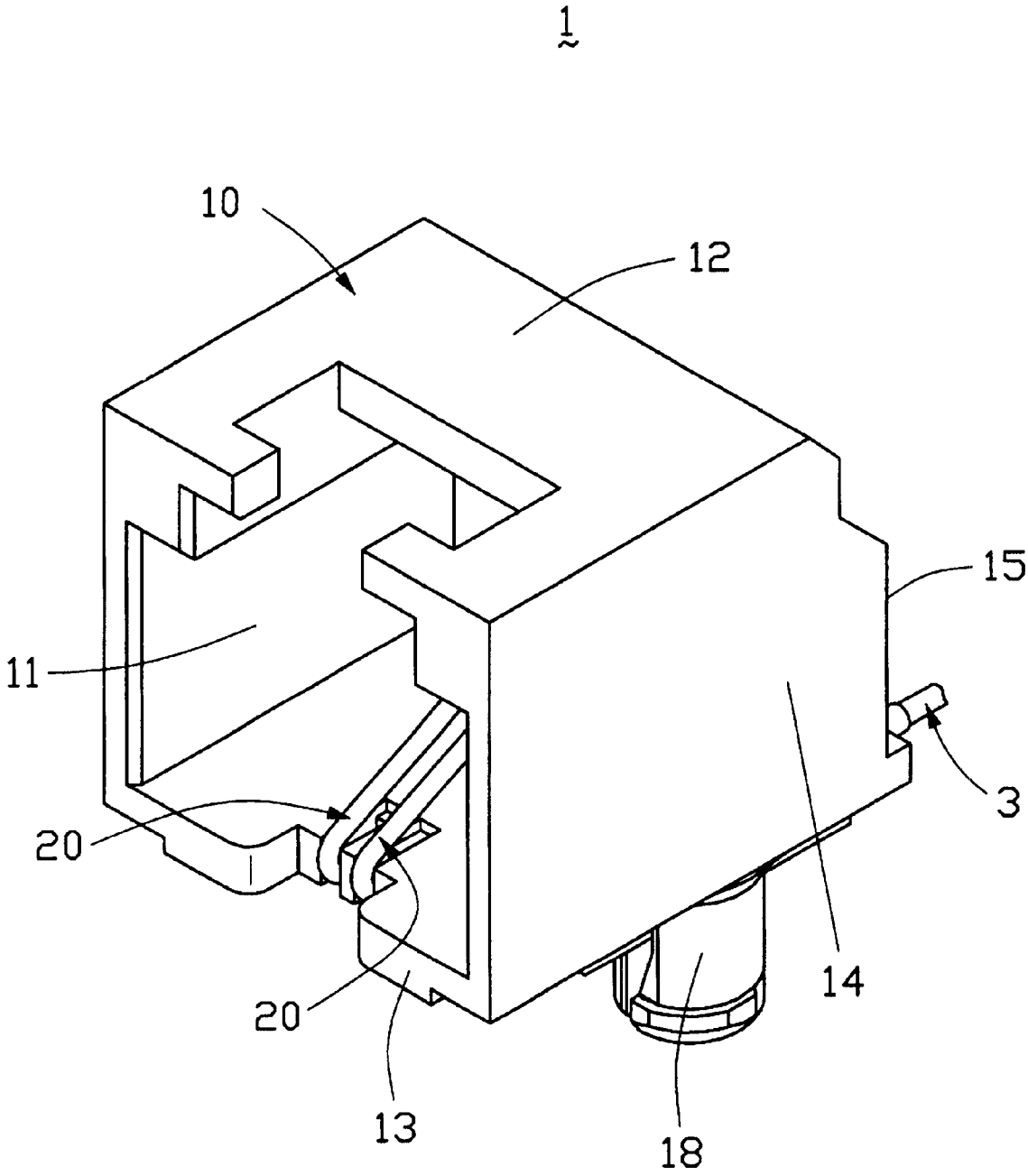
FIG. 2 is an assembled view of the modular jack shown in FIG. 1 with the wires terminated thereto.

Referring to FIGS. 1 and 2, a modular jack 1 for being mounted on a printed circuit board (not shown) in accordance with the present invention includes an insulating housing 10 and a pair of conductive contacts 20 received in the insulating housing 10. The pair of conductive contacts 20 provide an electrical connection between a pair of wires 3 and a mating plug (not shown). One of the conductive contacts 20 has a tail portion 201 thereof bent to apart from a tail portion 202 of the other conductive contact 20 for facilitate the soldering procedure between the tail portions 201, 202 and corresponding ends of the wires 3.

Figure 3:
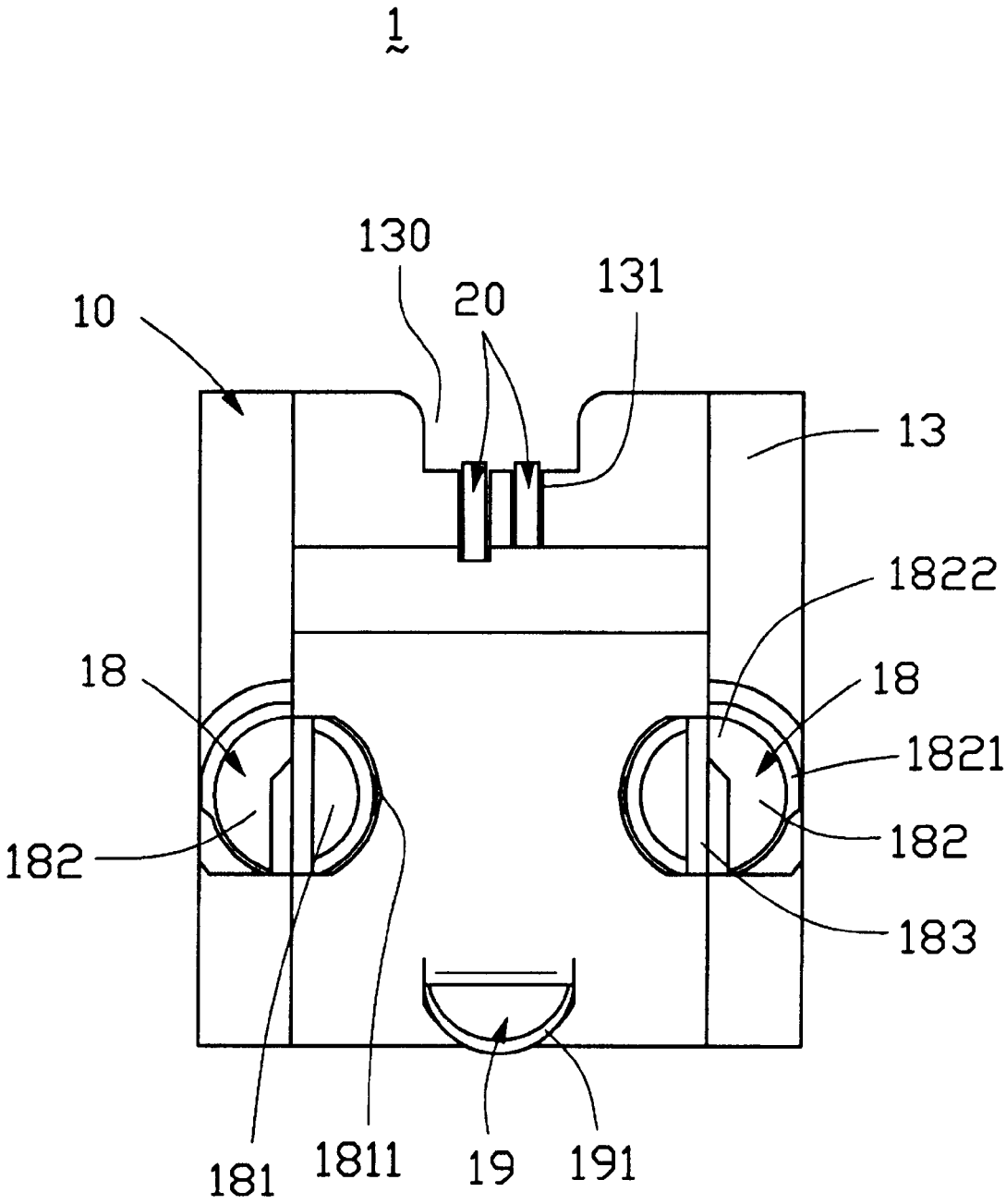
FIG. 3 is a bottom view of the modular jack shown in FIG. 2 with the wires omitted for simplicity.
Figure 4:
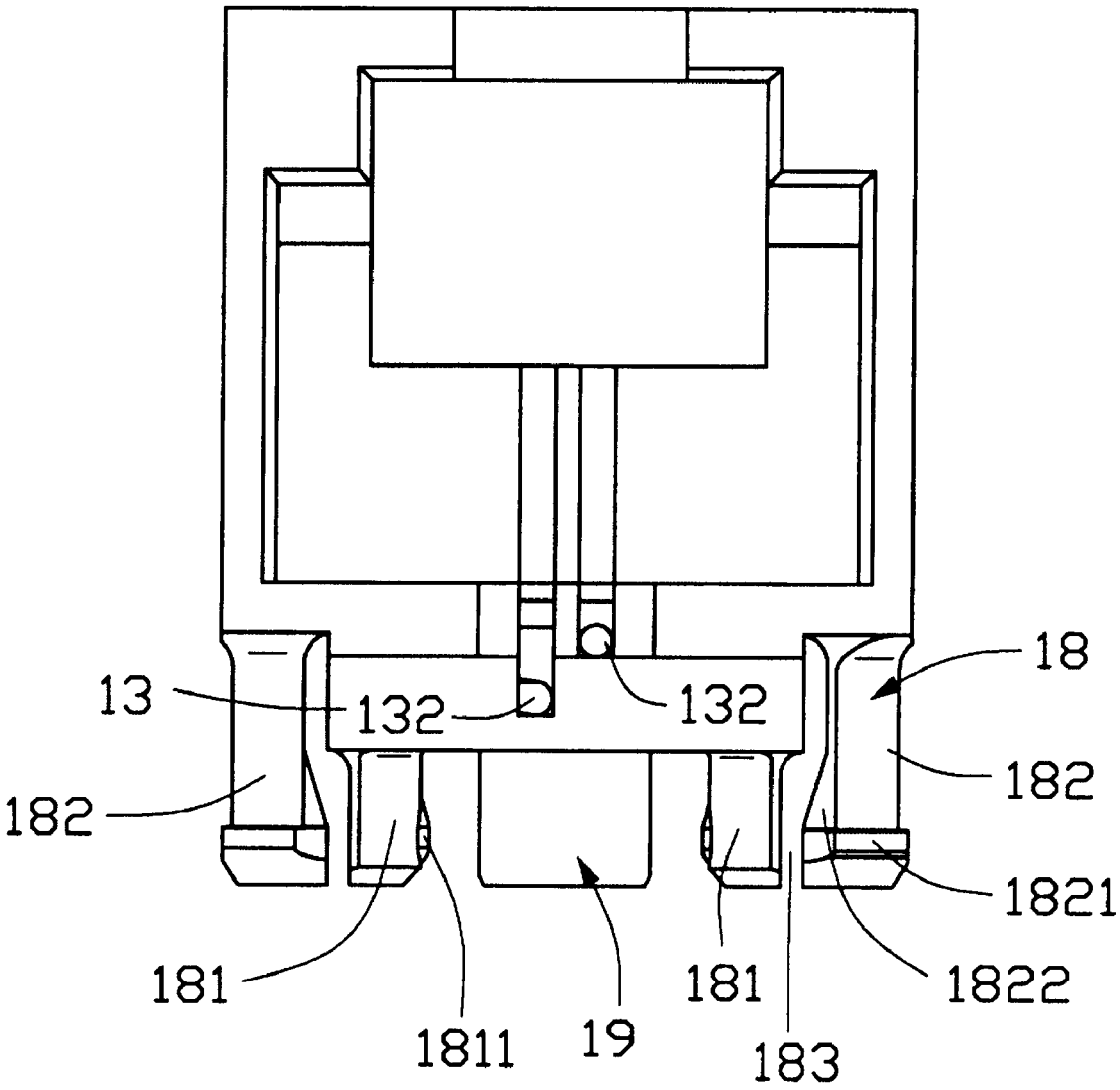
FIG. 4 is a front view of an insulating housing of the modular jack shown in FIG. 1.
Figure 5:
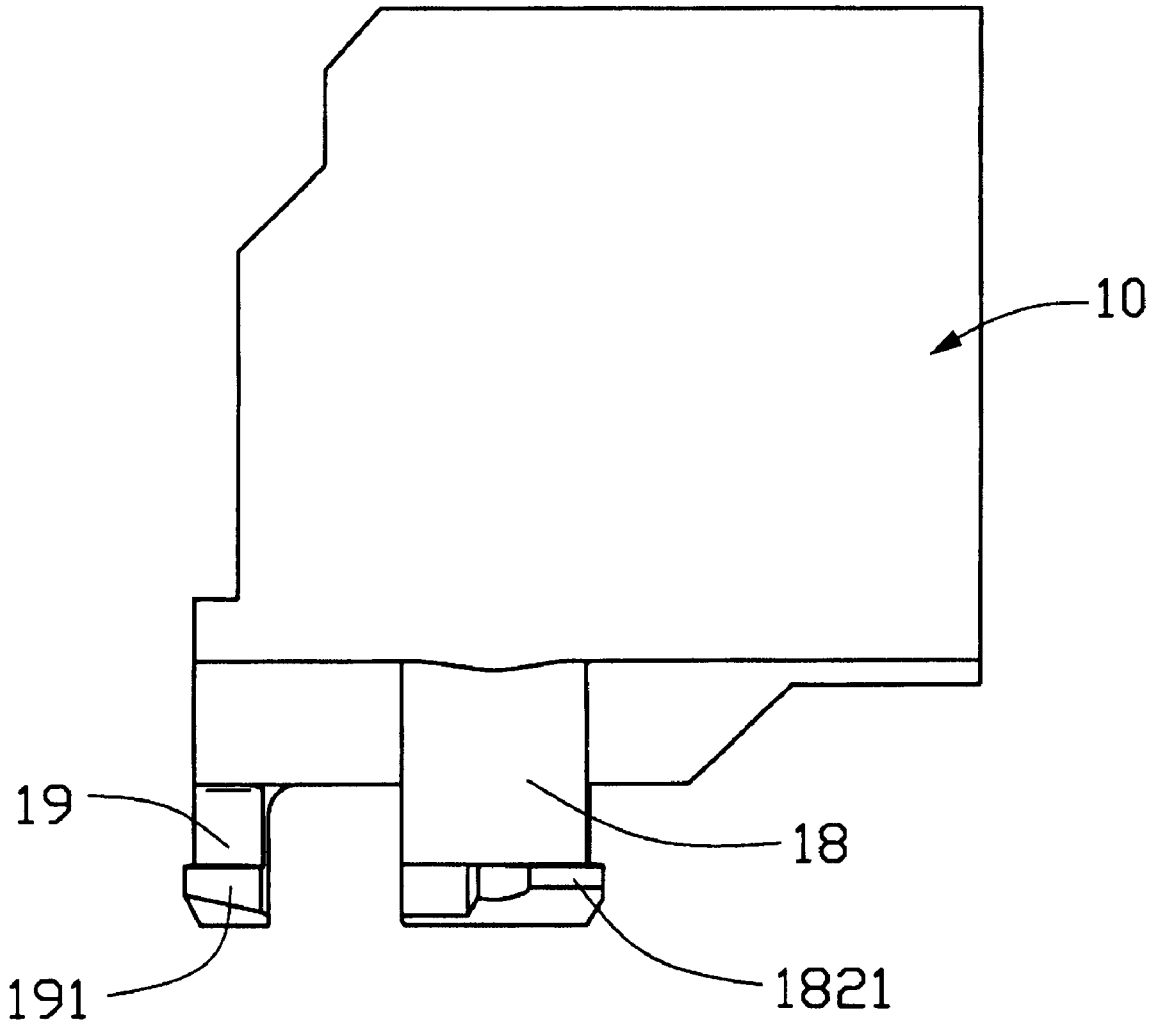
FIG. 5 is a side view of the insulating housing shown in FIG. 1.

Also referring to FIGS. 3–5, the insulating housing 10 has a top wall 12, a bottom wall 13, a rear wall 15 and a pair of side walls 14 together defining a plug insertion hole 11 therebetween for retaining the mating plug. A pair of resilient posts 18 for being mounted in corresponding through-holes of the printed circuit board project from opposite sides of the bottom wall 13. Each resilient post 18 includes an outer section 182 and an inner section 181, between which a slit 183 is defined to increase the resilience of the post 18. Each outer section 182 of the post 18 forms an annular protrusion 1821 extending forwardly from a bottom end thereof and a projection 1822 projecting into the slit 183. The inner sections 181 form a pair of respective ribs 1811 on inner sides thereof and extending toward each other. A tail post 19, which is configured as a half column, downwardly extends from a middle portion of a rear end of the bottom wall 13 for being inserted into a corresponding hole of the printed circuit board. The tail post 19 also comprises an annular tail protrusion 191 protruding rearwardly from a bottom end thereof.

The bottom wall 13 defines a recess 130 in a center thereof at entrance of the plug insertion hole 11, and two channels 131 communicating with the recess 130. A pair of contact insertion holes 132 are defined in the bottom wall 13 and communicate with corresponding channels 131 for receiving the pair of conductive contacts 20 therein.

By the provision of the two resilient posts 18 and the tail post 19, the modular jack 1 of the present invention can be securely mounted on the printed circuit board without additional securing means as required by the prior art. The protrusion 1821 of the resilient post 18 prevents the modular jack 1 from turning backwards and the tail protrusion 191 of the tail post 19 prevents the modular jack 1 from turning forwardly. In addition, the rib 1811 of the resilient post 18 further prevents vertical movement of the modular jack 1. Thus, the modular jack 1 can be securely fixed on the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack mounted on a printed circuit board and terminating with a cable end comprising an insulating housing and a plurality of conductive contacts received in the insulating housing, the insulating housing having a top wall, a bottom wall, a rear wall and a pair of side walls together defining a plug insertion hole therebetween for receiving a complementary plug, the insulating housing comprising:

a first resilient post forming a first arc protrusion thereon in a first angle range;

a second resilient post forming a second arc protrusion thereon in a second angle range;

a third resilient post forming a third arc protrusion thereon in a third angle range;

wherein the first and third resilient posts forming a pair of resilient posts downwardly extending from opposite sides of the bottom wall, and wherein the second post downwardly extending from the bottom wall between the first and third resilient posts; and wherein each of the first and third resilient post comprising an outer section, an inner section and a slit defined between the outer section and the inner section, the outer section comprises a projection extending into the slit, and the inner sections comprises a pair of respective ribs formed on inner side thereof and toward each other; and wherein the first, second and third resilient posts are configure to arrange in substantially an isosceles triangle; and wherein the first, second and third angle ranges are generally excluded from one another without overlapping while commonly defining about 360 degrees complementarily; and wherein the first and third arc protrusion are located on outer peripheries of the corresponding posts with regard to a center of the isosceles triangle; and wherein the first and third arc protrusion are symmetrical with regard to a center of the isosceles triangle.

2. The modular jack as described in claim 1, wherein the tail post is configured as a half column and comprises a tail protrusion protruding rearwardly from a bottom end thereof for preventing the modular jack from turning forwards.

3. The modular jack as described in claim 1, wherein the outer section of each resilient post comprises a protrusion protruding forwardly from a bottom end thereof for preventing the modular jack from turning backwards.

4. The modular jack as described in claim 1, wherein each conductive contact has a tail portion for soldering with the cable end, and the tail portion of one conductive contact is bent to apart from the tail portion of the other conductive contact for facilitating the soldering procedure between the tail portions and the cable end.

* * * * *